US005649558A

United States Patent [19]

Richard

[11] Patent Number: 5,649,558

[45] Date of Patent: Jul. 22, 1997

[54] ACCOMMODATION WALKER FOR IRREGULAR AND INCLINED SURFACES

[76] Inventor: Reginald L. Richard, 8834 Carey La., Pleasant Plane, Ohio 45162

[21] Appl. No.: 534,328

[22] Filed: Sep. 27, 1995

[51] Int. Cl.[6] ..... A61H 3/00

[52] U.S. Cl. ..... 135/67; 135/69; 135/79

[58] Field of Search ..... 135/67, 72, 69, 135/75; 482/66, 68, 69; 297/5–7; 280/87.021, 87.041, 87.051

[56] References Cited

U.S. PATENT DOCUMENTS

| | | | |
|---|---|---|---|
| 3,176,700 | 4/1965 | Drury, Jr. . | |
| 3,387,617 | 6/1968 | Reiber | 135/67 |
| 3,800,815 | 4/1974 | Birk . | |
| 4,411,283 | 10/1983 | Lucarelli | 135/67 |
| 4,777,973 | 10/1988 | Nakajima | 135/67 |
| 5,349,977 | 9/1994 | Wood | 135/67 |

*Primary Examiner*—Lanna Mai
*Attorney, Agent, or Firm*—John J. Mulrooney

[57] ABSTRACT

A walker is designed for use on level and inclined surfaces and for ascending and descending stairs. The walker is a free standing support having a pair of front legs and a pair of rear legs and two horizontally disposed handles. The front legs are lengthened or shortened relative to the rear legs through hand actuated controls located on each handle. The leg adjusting mechanism is a rack mounted on each front leg in releasable engagement with a frame-mounted gear which holds the leg at a fixed length. The hand controls act to disengage and reengage the gears and the racks to permit the front legs to either extend or retract as follows: with the racks and gears disengaged, the front legs will extend under the force of gravity until stopped at the desired length by a surface such as a stair, or the front legs may be retracted by pushing the front legs against a firm surface such as a stair until the legs are at the desired length, whereupon the control reengages the gear and rack to fix the front legs at the desired length.

8 Claims, 3 Drawing Sheets

FIG. 1
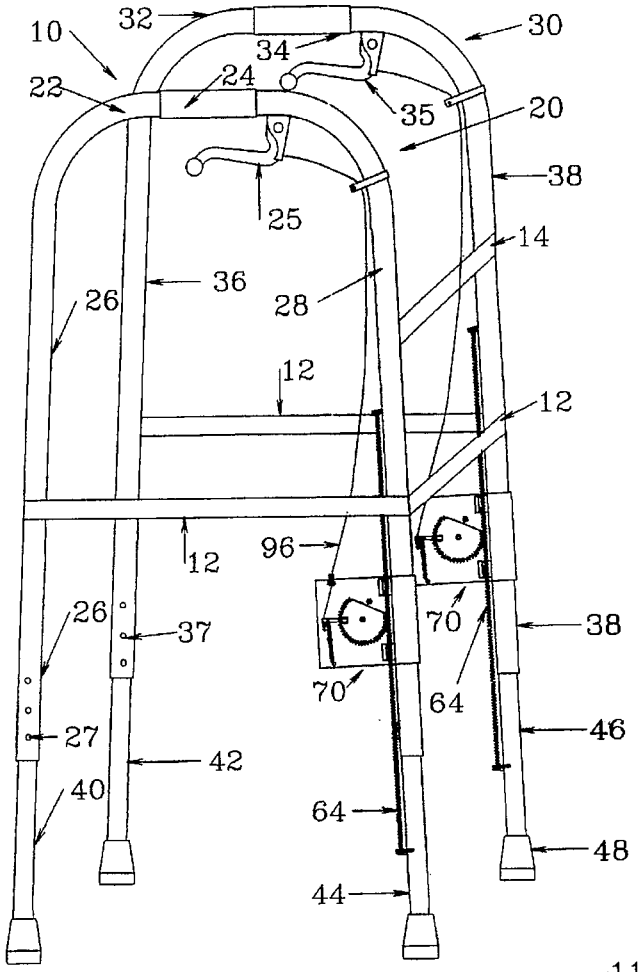
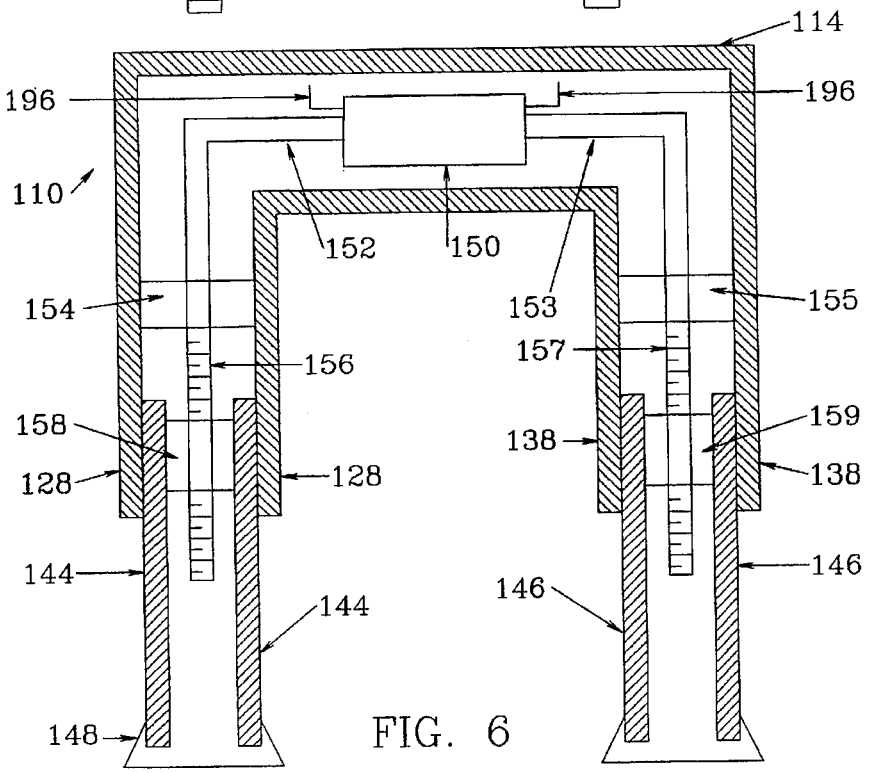
FIG. 6

ACCOMMODATION WALKER FOR IRREGULAR AND INCLINED SURFACES

BACKGROUND OF THE INVENTION

1. Field of the Invention

This invention relate s to walkers for use by persons needing ambulatory assistance. More particularly, this invention relates to an improved walker having front legs that may be adjusted in length relative to its rear legs to adapt the walker for safe use on irregular and inclined surfaces such as stairs, ramps, steps and curbs.

2. Description of the Prior Art

Alternate or accommodation walkers have been used to provide stability and walking assistance to aged and physically impaired persons. The most used walkers consist of a lightweight, three-sided frame that is self-standing on four legs, which often telescope to adjust the walker's height dimension to conform to the physical characteristics of the user. While such standard walkers provide a stable support when used on flat surfaces, they are highly unstable and unsafe when used on stairs.

This problem is recognized in the prior art and attempts have been made to design a walker that is stable and safe to use on all surfaces. Several such prior walkers are:

| U.S. Pat. No. | Inventor |
|---|---|
| 2,708,473 | Gable |
| 3,176,700 | Drury |
| 3,387,617 | Reiber |
| 3,387,618 | Swann |
| 3,421,529 | Vestal |
| 3,455,313 | King |
| 3,800,815 | Birk |
| 4,777,973 | Nakajima |
| 5,263,506 | Narramore |

These prior patents disclose various mechanisms for extending or retracting some or all of the legs thereof to adapt the walker for use in ascending or descending stairs. However, none of these references discloses a stair walker having a reliable yet simple and conveniently operable apparatus similar to the present invention for selectively extending and retracting the walker's two front legs.

SUMMARY OF THE INVENTION

It is an object of this invention to provide an improved walker for aged and physically impaired persons.

It is another object of this invention to provide an improve walker for assisting aged and physically impaired persons in ascending and descending stairs.

It is another object of this invention to provide an improved walker having a novel mechanism for selectively extending or retracting a pair of legs thereon for assisting a person in ascending or descending stairs.

It is another object of this invention to provide an improved walker having a novel mechanism for automatically and selectively controlling the extension and retraction of a pair of legs thereon.

It is another object of this invention to provide an improved walker having a convenient leg adjustment control that the user may activate without removing his/her hands from the walker's handles.

It is another object of this invention to provide an improved walker having a novel manually actuated leg adjustment control that the user may activate without removing his/her hands from the walker's handles.

It is another object this invention to provide an improved walker having a novel electro-mechanical leg adjustment control that the user may activate without removing his/her hands from the walker's handles.

In accordance with a preferred embodiment of the invention, a walker for accommodating persons needing ambulatory assistance, particularly on irregular surfaces such as stairs, steps, curbs and ramps, is a free-standing frame comprising a pair of inverted U-shaped frame members that are interconnected by braces at its sides and front, leaving the walker open on its rear side to allow access by the user. The horizontal parts of the U-shaped members provide handles for gripping the walker. A pair of adjustable front legs are telescopically inserted in the frame and are held in fixed position relative to the frame by a rack mounted on each front leg and pinion gears mounted on the frame. In one embodiment, hand actuated controls mounted on the handles allow the user to disengage the rack and gear mechanisms whereby the front legs extend by falling under the force of gravity to the desired length where the rack and gear are reengaged. Alternatively, the front legs are shortened by disengaging the rack and gear mechanism, pressing the front legs against a fixed surface until the legs are at the desired length where the rack and gear are reengaged. In another embodiment, a reversible motor or other electro-mechanical driving apparatus located in the handles or elsewhere on the walker frame drives worm gears to cause the adjustable front legs to either extend or retract with respect to the rear legs.

DESCRIPTION OF THE DRAWINGS

The foregoing and still other objects and advantages of the present invention will be more apparent from the following detailed explanation of the preferred embodiment of the invention in connection with the accompanying drawings herein in which:

FIG. 1 is a side perspective view, partly broken away, of one embodiment of an accommodation walker of the present invention showing the rack and gear mechanisms that control the extensions and retractions of the adjustable front legs.

FIG. 6 is a diagram view, partly cut away, of an alternative embodiment of present invention showing the front frame legs and telescoping adjustable legs therein and having a reversible motor that controls the front leg extensions and retractions through the act of a worm gear associated with the front frame legs and the adjustable legs.

DESCRIPTION 0F THE PREFERRED EMBODIMENTS

Figure 2:
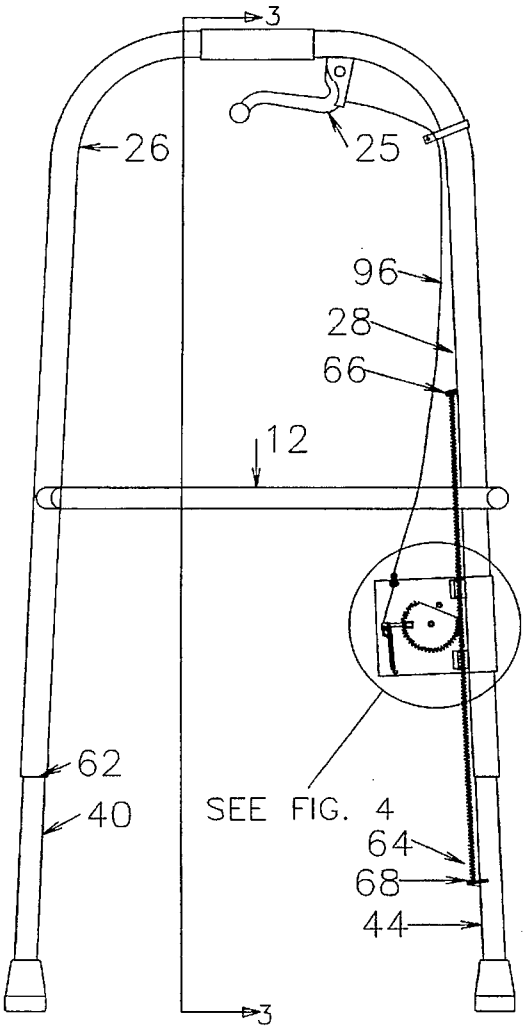
FIG. 2 is a side elevational view, partially cut-away, of the walker of the present invention that is illustrated in FIG. 1.
Figure 3:
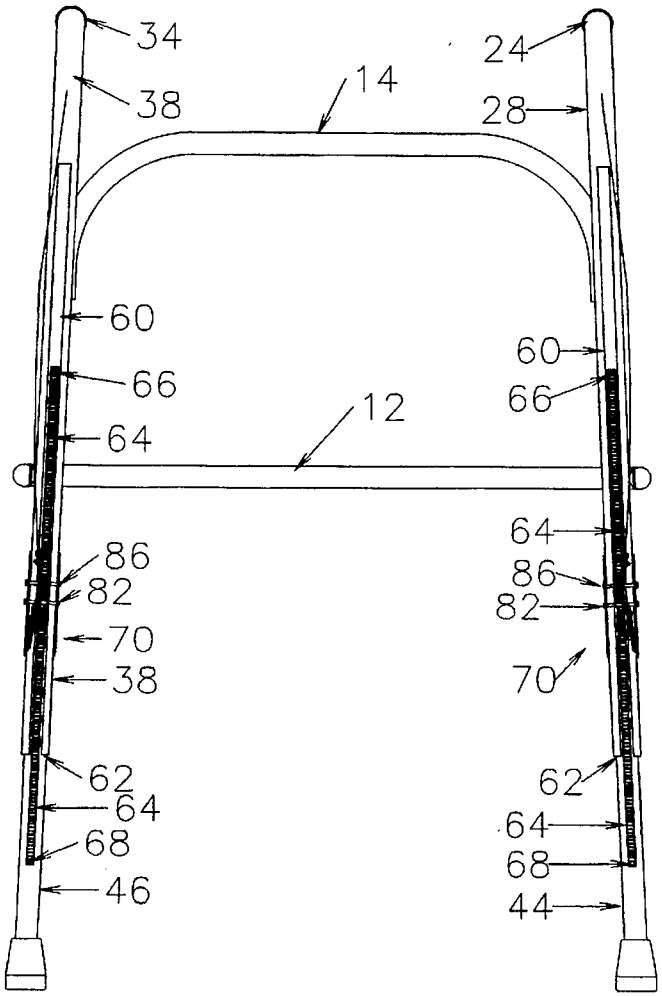
FIG. 3 is a sectional view taken along the lines 3—3 in FIG. 2 showing a rear view of the rack and gear mechanisms for extending and retracting the adjustable front legs.
Figure 4:
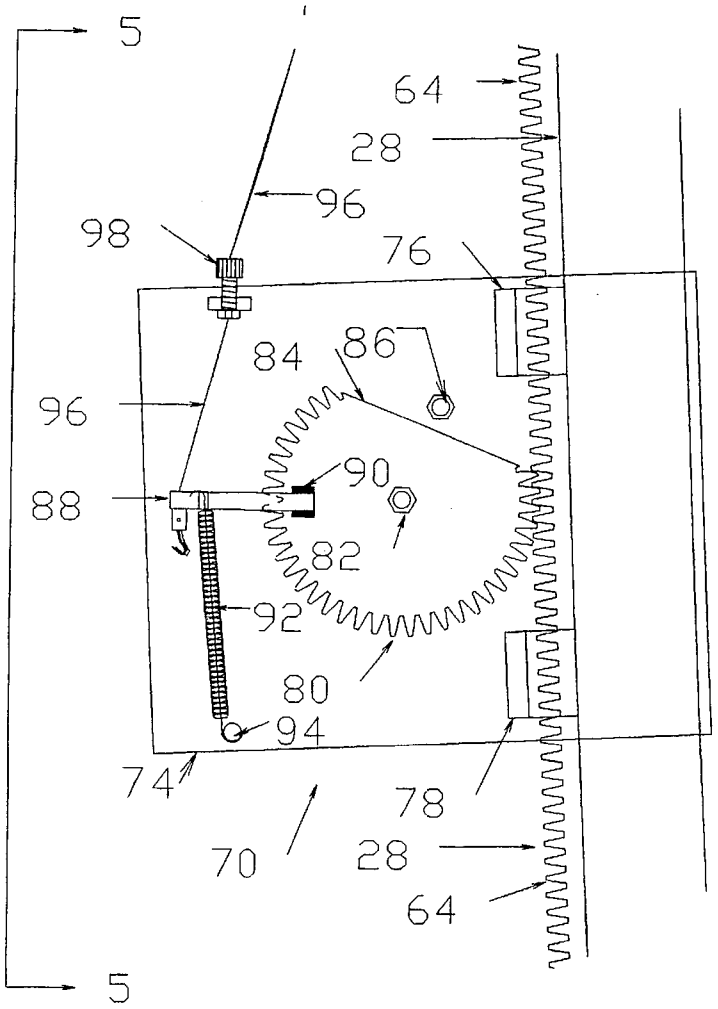
FIG. 4 is an enlarged side elevational view, partly cut-away, showing the rack and gear that controls the front leg extensions and retractions.
Figure 5:
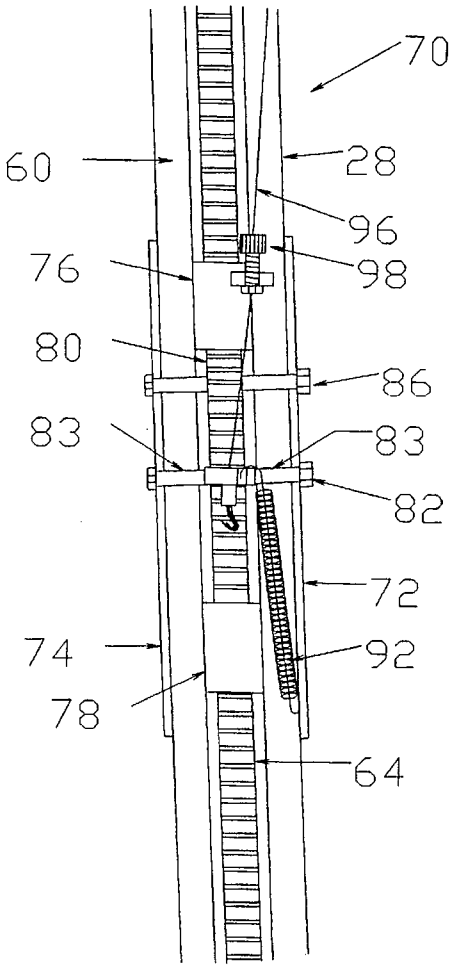
FIG. 5 is a sectional view taken along the lines 5—5 in FIG. 4 showing a rear elevational view, partly cut-away, of the gear housing 70.

Referring to the drawings, the several figures illustrate an accommodation walker having extendable and retractable front legs according to the invention. The walker, indicated generally by the reference numeral 10, is a self-standing support having right and left frame members indicated generally by the reference numerals 20 and 30, respectively, that are braced for rigidity and stability by a lower stabilizer bar 12 and an upper stabilizer bar 14. The right frame member 20 has substantially horizontal part 22 that functions as one handle or the walker and has a hand grip 24 thereon. The left frame member 30 has a substantially horizontal part 32 that functions as the other handle for the walker and has a hand grip 34 thereon. The frame 10 has a pair of rear frame legs 26 and 36 and a pair of front frame legs 28 and 38 that flare slightly outwardly with respect to the handles 22 and 32 (FIG. 3) to provide greater stability for the user. The frame 10 has a pair of adjustable rear legs 4 and 42 that are telescopically mounted for sliding movement within rear frame legs 26 and 36, respectively. Rear frame legs 26 and 36 have a plurality of leg extension holes 27 and 37, respectively, that cooperate with spring loaded push buttons (not shown) on the rear adjustable legs 40 and 42 to allow the walker to be adjusted for the height of the user as necessary. The walker 10 as a pair of adjustable front legs 44 and 46 that are telescopically mounted for sliding movement within front frame legs 28 and 38, respectively. Each ground-contacting leg, 40, 42, 44 and 46, has an anti-slip foot tip 48 at the bottom thereof.

A control handle 25, shown here as a bicycle brake grip, is mounted on right handle 22 adjacent to hand grip 24 and functions to release and reset the mechanism that controls the extensions and retractions of the right front adjustable leg 44 as hereinafter described. A control handle 35, shown here as a bicycle brake grip, is mounted on left handle 32 adjacent to hand grip 34 and functions to release and reset the mechanism that controls the extensions and retractions the left front adjustable leg 46 as hereinafter described.

The walker 10 may be constructed of a lightweight metal such as aluminum and the right and left frame members 20 and 30 may comprise one-piece U-shaped frame pipes whose rear and front frame legs 26, 36, 28 and 38 are designed to receive rear and front adjustable legs 40, 42, 44 and 46, respectively, in a sliding, telescoping relationship. Also, the frame members 20 and 30 and braces 12 and 14 may be designed to be foldable for convenience when the walker is transported or stored. The walker 10 comprises a self-standing frame having four legs and four sides wherein a front side is defined by frame legs 28 and 38, a right side is defined by frame legs 26 and 28, a left side is defined by frame legs 36 and 38, and a rear side is defined by frame legs 26 and 36.

Referring in particular to FIGS. 2–5, the novel mechanism for controlling the selective extension and retraction of the front adjustable legs 44 and 46 will be described. Since the control mechanisms for extending ad retracting the right and left front adjustable legs 44 and 46 are identical, the description and operation of the control apparatus for only right leg 44 will be given and identical parts of the control apparatus associated with the right frame side 20 and the left frame side 30 will be referred to by the same reference number.

The right front frame leg 28 has a longitudinal window or slot 60 (FIG. 3) that extends along the posterior or rear-facing side of leg 28 from a point above stabilizer bar 14 to the lower end 62 of leg 28. The right front adjustable leg 44 has an elongated 8-pitch rack 64 mounted longitudinally thereon by means of a top rack bolt 66 and a bottom rack bolt 68. When adjustable leg 44 reciprocates within frame leg 28 in telescope fashion, the rack bolts 66 and 68 track along slot 60 in leg 28. A housing (not shown) may be mounted on leg 28 to cover the slot 60 and rack 64. While the rack 64 is shown mounted on the surface of leg 44, it will be apparent to those skilled in the art of such mechanisms that rack 64 could be mounted within leg 44 and the apparatus would function in the same manner.

A gear housing designated generally by the reference numeral 70 has a pair of side housing plates 72 and 74 that are mounted in parallel fashion on opposite sides of the right front frame leg 28 and extend rearwardly past the rack 64 towards the back side of the walker frame 10. In the embodiment shown, the gear housing is not closed at its top, bottom and rear sides, although such additional parts could be added if desired. A top rack stop 76 and a bottom rack stop 78 are mounted in the gear housing 70 adjacent to the rack 64 and function stop the top rack bolt 66 and bottom rack bolt 68 from passing. The longest extension of adjustable leg 44 is defined by stop block 76 which will not allow stop bolt 66 to pass; and the most possible retraction of adjustable leg 44 is defined by stop block 78 which will not allow stop bolt 68 to pass.

An 8-pitch gear 80 is mounted on a bolt 82 between housing plates 72 and 74 in a position to mesh with the rack 64. Spacers 83 may be used to center the gear 80 on bolt 82. A fail safe bolt 86 is mounted between gear housing plates 72 and 74 and is positioned to contact a flat side 84 of gear 80 when the gear 80 rotates past its designed limit of rotation as hereinafter described. A gear lever attachment 88 is mounted on gear 80 by a weld 90 or other suitable means. A tension coil spring 92 is attached between the gear lever 88 and a bolt 94 in housing panel 72 and functions to urge gear 80 to rotate in a counterclockwise direction. A control cable 96 is connected from the control handle release/reset means 25 through a cable connector 98 to the gear lever 88. When the control handle 25 is actuated, the upward force of the cable on the gear lever 88 overcomes the biasing force of the tension spring 92 and permits gear 80 to rotate freely in a clockwise direction until the rack 64 and gear 80 disengage.

In operation, when the walker's user desires to extend the front legs, the user actuates the control means 25 which will cause the cable 96 to exert an upward force on the gear lever 88 to overcome the biasing action of spring 92 and permit a clockwise rotation of gear 80, thereby causing the gear and rack 64 to disengage and permit front leg 44 to extend freely under the force of gravity until either it contacts a solid object or the top rack stop bolt 66 contacts the top rack stop block 76. When the front adjustable leg 44 is at the desired extended length, the control handle is released whereby the spring 92 causes the gear to rotate until it engages the rack and locks leg 44 at that position. When the user desires to retract the front legs, the user will actuate the handle 25 to disengage the gear 80 and rack 64 and then apply an upward force on the front legs by, for example, pushing the front legs against the ground or a rigid object until the front legs are at the desired length whereupon the control handle 25 will be released to allow gear 80 to rotate counterclockwise until it engages and locks rack 64 and attached leg 44 at the desired length. The fail safe bolt 86 is a back-up safety feature that functions to prevent the gear 80 from rotating counterclockwise too far when the gear is engaged and force is applied in an upward direction on the front walker legs 44 and 46. An additional safety mechanism is the feature that the teeth of the gear 80 are designed to align with the gear rack 64. With this design, when an upward force is placed on the front walker legs, i.e., when the walker is used, the gear and rack are urged toward a closer engagement.

Referring now to FIG. 6, an alternative embodiment of the present invention is illustrated wherein an electro-mechanical means such as a reversible motor is used to power and control the extensions and retractions of the movable front legs of the walker. FIG. 6 is a diagrammatic illustration of the front frame legs, the associated telescoping adjustable front legs and the upper frame brace member of the walker. The remaining parts of the walker will be as illustrated in FIG. 1 and are not shown in FIG. 6. The electro-mechanical means for controlling the extensions and retractions of the adjustable front legs 144 and 146 will be described. The upper stabilizer bar 114 may be formed as an integral part of the walker frame 11 as shown in FIG. 6 or it may be a separate member of the frame as shown in FIG. 1 without changing the operation of this alternative embodiment of the invention. An electro-mechanical drive means illustrated diagrammatically by the numeral 150 may be a reversible motor, or apparatus such as a solenoid capable of reversible or bi-directional action, is mounted in stabilizer bar 114. It will be apparent that the drive means 150 could be mounted as an external fixture on the walker frame 110 without changing the operation of the invention. A first flexible shaft 152 extends from drive means 150 into the right front frame leg 128 where it is connected in a driving relationship to a threaded shaft or worm gear 156 that is mounted in frame leg 128 by an anchor bearing 154. The worm gear 156 is threadingly engaged in a support nut 158 that is rigidly fixed to movable front leg 144. A second flexible shaft 153 extends from drive means 150 into the left front frame leg 138 where it is connected in a driving relationship to a threaded shaft or worm gear 157 that is mounted in frame leg 138 by an anchor bearing 155. The worm gear 157 is threadingly engaged in a support nut 159 that is rigidly fixed to movable front leg 146. The drive means 150 will be actuated by switch (not shown) which is mounted on the handle as shown in FIG. 1. and which will have three positions representing a down or extend leg mode, an up or retract leg mode and a neutral or fixed leg length mode. The wiring connections between the hand control switch and drive means 150 are illustrated at 196 may be concealed within the frame 110.

The operation of the alternative embodiment shown in FIG. 6 will now be described. When the walker's user desires to extend the front legs, she/he will position the hand control switch to the down position whereupon the motor or other drive means 150 will cause drive shafts 152 and 153 to rotate which in turn will cause the worm gears 156 and 157 to rotate. Because worm gears 156 and 157 are threadingly engaged with the support nuts 158 and 159 that in turn are fixedly attached to lower adjustable legs 144 and 146, respectively, the lower legs will be extended by the screwing action between the worm gears and the support nuts. When the user wishes to retract the movable front legs 144 and 146, she/he puts the control switch in the retract position and the reversible drive means 150 causes the shafts 152 and 153 to rotate in the opposite direction whereby the legs 144 and 146 will be retracted with respect to walker frame 110 to the desired position.

The present invention has been described in detail with regard to its preferred embodiments in an accommodation walker having two front leg units that may selectively be extended or retracted to enable the walker to be safely used on stairs, curbs, steps and inclined surfaces. However, as those skilled in the art will readily understand upon a reading of the foregoing specification, modifications and variations may be resorted to without departing from the substance or scope of the invention. Specifically, it is contemplated that the features of the present invention may be equally adaptable for use in walkers having front and rear adjustable legs and walkers having foldable frames. Such modifications and variations are within the scope of the present invention, which is intended to be limited only by the appended claims and equivalents thereof.

What is claimed is:

1. In a walker consisting of a four-sided frame having a front side, a back side, a right side and a left side, said walker having right and left handles and pairs of front and rear legs, said front legs being capable of extending and retracting relative to said frame, an improved apparatus for controlling the extensions and retractions of said front legs comprising:

a pair of front legs, each leg having a frame leg part and an adjustable leg part that telescopes relative to said frame leg part;

a gear mounted on and co-planar with said frame leg part for engaging said adjustable leg part and holding said adjustable leg part in a fixed position relative to said frame;

a rack mounted on and co-planar with said adjustable leg part for engaging said gear and holding said adjustable leg part in a fixed position relative to said frame;

hand operated control means positioned on each handle for disengaging said gear and rack, whereby said adjustable leg part will move relative to said frame; and stop means on said frame leg part and said adjustable leg part for limiting the maximum extension and retraction of said adjustable leg part relative to said frame.

2. A walker according to claim 1 wherein said gear is mounted rearward of said adjustable leg part and said rack is mounted along the rear-facing side of said adjustable leg part.

3. A walker according to claim 1 wherein said hand operated control means mounted on each handle for disengaging said gear and rack comprises a bicycle brake grip.

4. A walker according to claim 1 wherein said gear has a flat side, and further comprising a fail safe bolt positioned to contact said gear flat side when said gear rotates past a predetermined limit of rotation.

5. A walker having adjustable length legs for use on flat surfaces and in ascending and descending stairs comprising:

a frame having a right side, a back side; a left side and a front side, said walker further having right and left handles and a pair of front legs and a pair of rear legs, said front legs having a stationary part relative to said frame and an adjustable part that moves relative to said stationary part;

a rack mounted on the posterior side of and co-planar with said adjustable part;

a gear rotatably mounted on and co-planar with said stationary part, said gear being capable of rotating from a position of engagement with said rack to a position of non-engagement with said rack;

means mounted on said handle and connected to said gear for causing said gear and rack to disengage, whereby said adjustable part will move relative to said frame; and stop means mounted on said stationary part and said adjustable part for limiting the maximum extension and retraction of said adjustable part.

6. A walker according to claim 5 wherein said adjustable front leg part telescopes with respect to said stationary front leg part.

7. A walker according to claim 5 wherein said means for causing said gear and rack to disengage comprise hand operated controls mounted on said handles.

8. A walker according to claim 5 wherein said gear has a flat side, and further comprising a fail safe bolt positioned to contact said gear flat side when said gear rotates past a predetermined limit of rotation.

* * * * *